US007708080B2

(12) United States Patent
Conaway et al.

(10) Patent No.: US 7,708,080 B2
(45) Date of Patent: May 4, 2010

(54) PACKER

(75) Inventors: Seth Conaway, Pearland, TX (US); Karen Grosser, Pearland, TX (US); James D. Hendrickson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 202 days.

(21) Appl. No.: 11/307,916

(22) Filed: Feb. 28, 2006

(65) Prior Publication Data

US 2006/0289173 A1 Dec. 28, 2006

Related U.S. Application Data

(60) Provisional application No. 60/595,338, filed on Jun. 23, 2005.

(51) Int. Cl.
*E21B 33/12* (2006.01)

(52) U.S. Cl. ..... 166/387; 166/120; 166/203

(58) Field of Classification Search ..... 166/387, 166/179, 203, 120
See application file for complete search history.

(56) References Cited

U.S. PATENT DOCUMENTS

| | | | | | |
|---|---|---|---|---|---|
| 3,215,205 | A | * | 11/1965 | Sizer | 166/120 |
| 4,436,149 | A | * | 3/1984 | Edwards | 166/120 |
| 4,441,552 | A | * | 4/1984 | Hamman | 166/133 |
| 4,697,640 | A | * | 10/1987 | Szarka | 166/120 |
| 4,753,444 | A | * | 6/1988 | Jackson et al. | 277/342 |
| 4,765,404 | A | * | 8/1988 | Bailey et al. | 166/117.6 |
| 5,271,468 | A | * | 12/1993 | Streich et al. | 166/387 |
| 5,353,871 | A | | 10/1994 | Eslinger | |
| 5,390,737 | A | * | 2/1995 | Jacobi et al. | 166/184 |
| 5,398,755 | A | | 3/1995 | Eslinger | |
| 5,404,947 | A | | 4/1995 | Sorem | |
| 5,720,343 | A | * | 2/1998 | Kilgore et al. | 166/120 |
| 5,743,333 | A | | 4/1998 | Willauer | |
| 5,857,520 | A | * | 1/1999 | Mullen et al. | 166/196 |
| 5,961,123 | A | | 10/1999 | Ingram | |
| 6,112,811 | A | * | 9/2000 | Kilgore et al. | 166/134 |
| 6,343,791 | B1 | | 2/2002 | Anyan | |
| 6,536,532 | B2 | | 3/2003 | Doane | |
| 6,896,061 | B2 | * | 5/2005 | Hriscu et al. | 166/313 |
| 2003/0226660 | A1 | * | 12/2003 | Winslow et al. | 166/118 |
| 2004/0069502 | A1 | * | 4/2004 | Luke | 166/387 |
| 2005/0077053 | A1 | | 4/2005 | Walker | |
| 2006/0243457 | A1 | * | 11/2006 | Kossa et al. | 166/387 |

FOREIGN PATENT DOCUMENTS

| | | | |
|---|---|---|---|
| EP | 0 794 316 | B1 | 9/2004 |
| EP | 1 339 944 | B1 | 10/2004 |
| GB | 2107761 | A | 5/1983 |
| GB | 2296520 | A | 3/1996 |
| WO | WO 02/46573 | A1 | 6/2002 |

* cited by examiner

*Primary Examiner*—David J Bagnell
*Assistant Examiner*—Cathleen R Hutchins
(74) *Attorney, Agent, or Firm*—Rodney V. Warfford; Trop, Pruner & Hu PC

(57) ABSTRACT

A packer includes a sealing element, a gage and a plurality of foldback rings. The rings are located between the gage and the sealing element.

18 Claims, 5 Drawing Sheets

PACKER

This application claims the benefit under 35 U.S.C. §119 (e) to U.S. Provisional Patent Application No. 60/595,338, entitled "PACKER ELEMENT SECONDARY FOLD BACK RING," which was filed on Jun. 23, 2005, and is hereby incorporated by reference in its entirety.

BACKGROUND

The invention generally relates to a packer.

A packer is a tool that typically is used in a well for purposes of forming an annular seal between the outer surface of a string (a production tubing, for example) and either the surrounding casing or borehole wall, depending on whether the well is cased. The packer typically includes a ring-like elastomer seal element, which is longitudinally compressed by the thimbles, or gages, of the packer to cause the seal element to radially expand to form the annular seal when the packer is set.

When compressed, the seal element has a tendency to undergo longitudinal extrusion. Because significant longitudinal extrusion may cause a loss of the annular seal (and potentially a catastrophic blowout), the packer typically includes a seal backup system to limit the extent of the longitudinal extrusion. Ideally, a backup system prevents catastrophic blowout of the elastomer seal element at the well pressure; is fully set with a limited setting force; and allows the packer to be unset (for retrievable packers). It may be challenging for a conventional backup system to accomplish these goals, due to ever-increasing well pressure in the environment in which the packer operates.

SUMMARY

In an embodiment of the invention, a packer includes a sealing element, a gage and a plurality of foldback rings. The rings are located between the gage and the sealing element.

In another embodiment of the invention, a system includes a packer and tubular member, which defines an annulus in the well. The packer is adapted to seal off the annulus in response to the packer being set. The packer includes a sealing element, a gage and a plurality of foldback rings, which are located between the gage and the sealing element.

In yet another embodiment of the invention, a technique that is usable with a well includes compressing a sealing element between gages to form an annular seal in the well. The technique includes controlling extrusion of the sealing element, a control that includes deforming a plurality of rings that are located between one of the gages and the sealing element.

Advantages and other features of the invention will become apparent from the following drawing, description and claims.

DETAILED DESCRIPTION

Figure 1:
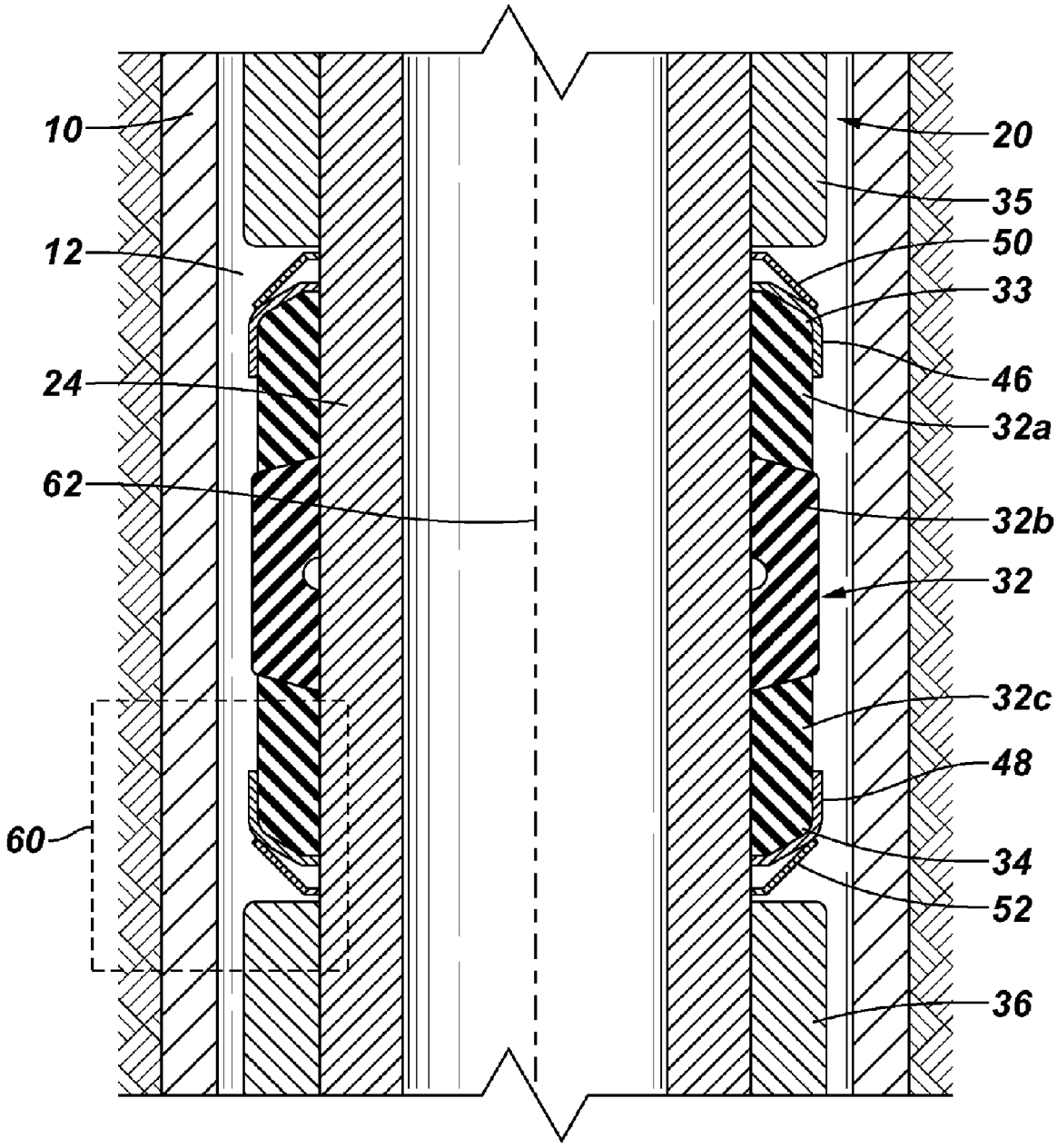
FIG. 1 is a schematic diagram of a packer before the packer is set according to an embodiment of the invention.

Referring to FIG. 1, in accordance with embodiments of the invention, a packer 20 (depicted before being set in FIG. 1) includes a seal element 32, which may be formed from several elastomer seal rings (seals rings 32*a*, 32*b* and 32*c*, depicted as examples). The seal rings 32*a*, 32*b* and 32*c* surround an inner tubular member 24 (which contains the packer's central passageway) of the packer 20; circumscribe a longitudinal axis 62 of the packer 20; and are exposed to an annulus 12 that exists between the rings 32*a*, 32*b* and 32*c* and the inner surface of a well casing 10. It is noted that the seal element 32 may be formed from more or less than three seal rings (one seal ring, for example), depending on the particular embodiment of the invention. The seal element 32 is constructed to be radially expanded when the packer 20 is set to form an annular seal between the outer surface of the tubular member 24 and the interior surface of the casing 10. For other embodiments of the invention in which the borehole is uncased, the seal element 32 expands (when the packer 20 is set) to form a seal with the surrounding borehole wall.

For purposes of compressing the seal element 32 when the packer 20 is set, the packer 20 includes collars, or gages (also called "thimbles"), that slide together to compress the seal element 32, which is located in between. More specifically, in accordance with some embodiments of the invention, the packer 20 includes upper 35 and lower 36 gages, which longitudinally compress the seal element 32 (when the packer 20 is set) to radially expand the element 32. In this regard, the packer 20 may include a mandrel (not shown in FIG. 1) that moves when the packer 20 is being set for purposes of moving one or both of the gages 35 and 36 to compress the seal element 32.

For purposes of limiting, if not preventing, the longitudinal extrusion of the seal element 32 when the packer 20 is set, the packer 20 includes a seal backup system, which includes multiple foldback rings between each gage 35, 36 and the seal element 32. More particularly, the seal backup system includes foldback rings 46 and 50 that are concentric with the longitudinal axis 62 of the packer 20 and surround the inner tubular member 24. Longitudinally, the foldback rings 46 and 50 are located between an upper edge 33 of the seal element 32 and the upper gage 35. The seal backup system also includes foldback rings 48 and 52 that are concentric with the longitudinal axis 62; surround the tubular member 24; and are longitudinally located between a lower edge 34 of the seal element 32 and the lower gage 36.

The foldback rings 46 and 48, which are located closest to the seal element 32, are primary foldback rings that generally conform to the profiles of the edges 33 and 34, respectively; and provide the overall strength to minimize longitudinal extrusion of the seal element 32. Foldback ring 50 is a secondary foldback ring that forms a buffer between the primary ring 46 and the upper gage 35; and likewise, foldback ring 52 is a secondary foldback ring that forms a buffer between the primary foldback ring 48 and the lower gage 36. As described further below, the secondary foldback rings 50 and 52 allow the seal element 32 to achieve higher pressure ratings without compromising the seal element's ability to be set or retrieved, because the secondary foldback rings 50 and 52 do not touch the casing 10 when the packer 20 is set.

Each of the secondary foldback rings 50 and 52 effectively increases the outer diameter of its associated gage, 35,36, which, in turn, increases the pressure handling capability of the seal element 32. Furthermore, each secondary foldback ring 50, 52 effectively reduces the longitudinal extrusion of the seal element 32 by a minimum of the thickness of the ring 50, 52 itself. Additionally, the secondary foldback rings 50 and 52 reduce the stress risers that are applied to the primary foldback rings 46 and 48 by the gages 35 and 36, as further described below.

FIG. 1 depicts features of the packer 20 relevant to the annular seal element 32 and its backup system. However, as can be appreciated by one skilled in the art, the packer 20 may have many additional features, such as slips to secure the packer 20 to the casing 10, one or more mandrels to activate the slips and move the gages 35 and 36, etc.

As depicted in FIG. 1, when the packer 20 is first run downhole and unset, only the outer portion of an inner surface of the secondary foldback ring 50 and 52 touch the adjacent primary foldback ring 46, 48. This arrangement maximizes the moment forces that are applied to the secondary foldback rings 50 and 52 when the packer 20 is set and thus, reduces the overall force that is needed to set the packer 20.

Figure 2:
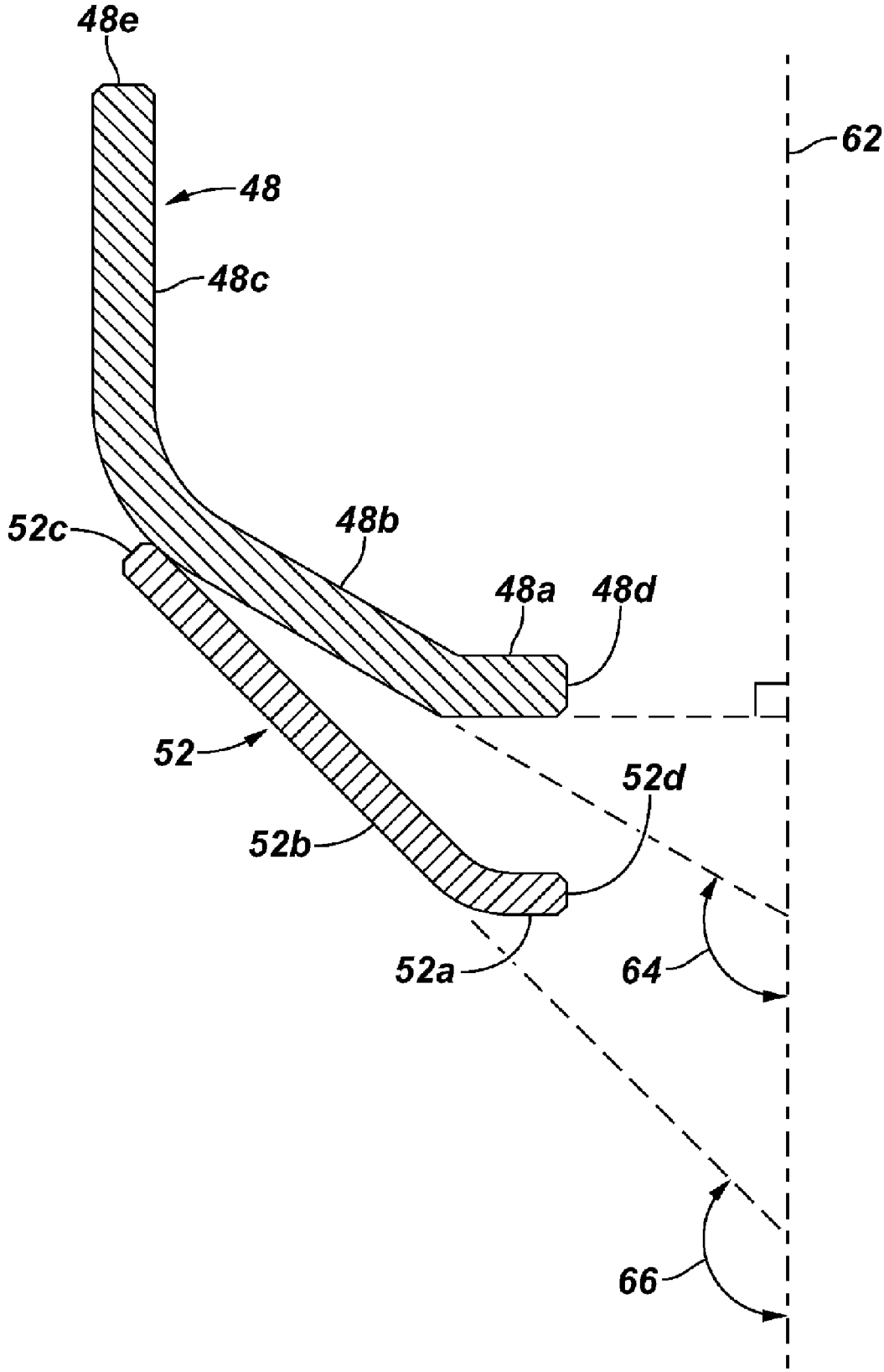
FIG. 2 illustrates cross-sectional profiles of foldback rings of the packer according to an embodiment of the invention.

The specific geometries of the primary 48 and secondary 52 foldback rings are illustrated in FIG. 2, which is an enhanced view of section 60 of FIG. 1. The primary 46 and secondary 50 foldback rings may have similar designs to the primary 48 and secondary 52 foldback rings, in accordance with some embodiments of the invention. Thus, the primary foldback rings 46 and 48 may be identical and the secondary foldback rings 50 and 52 may be identical, in accordance with some embodiments of the invention.

Referring to FIG. 2 in conjunction with FIG. 1, the primary foldback ring 48, in accordance with some embodiments of the invention, generally follows the profile of the lower edge 34 of the seal element 32 when the packer 20 is unset. As shown in FIG. 2, the primary foldback ring 48 radially extends between an inner edge 48*d* (closest to the outer surface of the tubular member 24) of the ring 48 and an outer edge 48*e* of the ring 48. In this regard, the primary foldback ring 48 includes three annular sections: a first annular section 48*a*, which is radially closest to the tubular member 24 and extends radially away from the longitudinal axis 62 with generally no longitudinal variation; a middle annular section 48*b* that radially extends away from the annular section 48*a* and longitudinally increases at an angle 64; and an outer section 48*c* that extends upwardly from the annular section 48*b* and has a generally constant radius with respect to the longitudinal axis 62.

In accordance with some embodiments of the invention, the secondary foldback ring 52 is constructed so that only an outermost edge 52*c* of the ring 52 contacts the primary foldback ring 48 when the packer 20 is unset. For purposes of forming this relationship between the primary 48 and secondary 52 foldback rings, the foldback ring 52 has an inclined section 52*b*, which rises at a steeper angle 66 (with respect to the longitudinal axis 62) than the section 48*b* of the primary foldback ring 48. More specifically, in accordance with some embodiments of the invention, the secondary foldback ring 52 radially extends between an innermost edge 52*d* and the outermost edge 52 and includes two annular sections: a first inner annular section 52*a*, which closely circumscribes the outer surface of the tubular member 24 (FIG. 1) and generally has no longitudinal variation; and an outer annular section 52*b*, which radially extends away from the annular section 52*a* and longitudinally increases at the angle 66.

Figure 3:
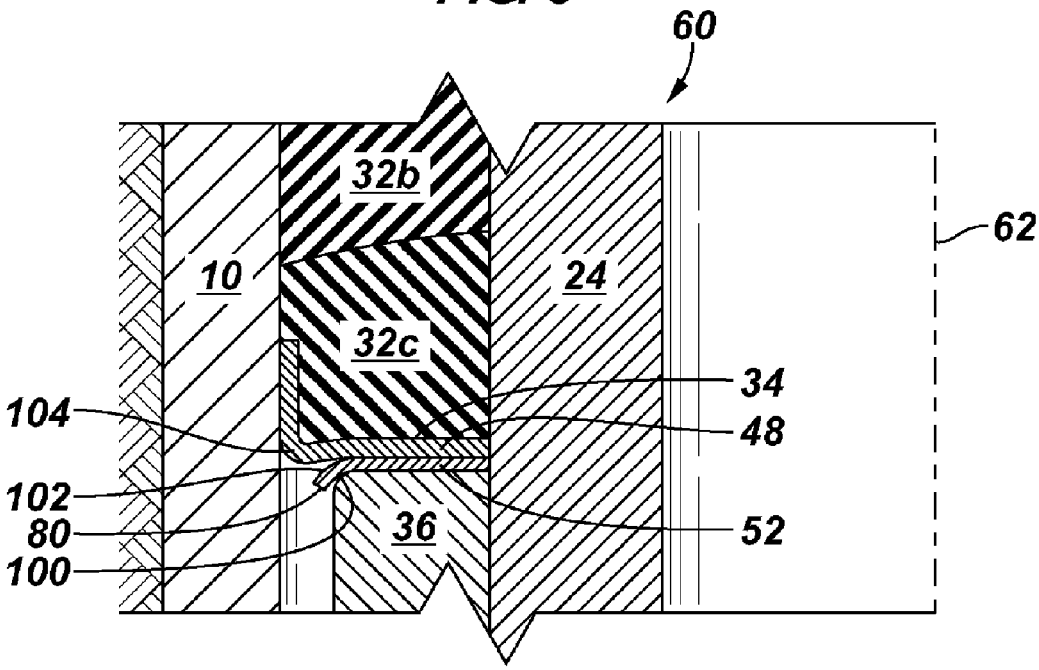
FIG. 3 is a schematic diagram depicting a more detailed view of a section of the packer of FIG. 1 when the packer is set according to an embodiment of the invention.

FIG. 3 generally depicts the detailed section 60 (see FIG. 1) in a state that occurs when the packer 20 is set. In this configuration, the primary 48 and secondary 52 foldback rings are deformed between the seal ring 32*c* (of the seal element 32) and lower gage 36. As shown in FIG. 3, in this state, the primary foldback ring 48 bends upwardly at edge 104 to contain the seal element 32. The secondary foldback ring 52 also bends (at edge 102) toward the lower gage 36 due to the contact of an outer upper shoulder 100 of the lower gage 36 with the secondary foldback ring 52. As shown in FIG. 3, in the absence of the second foldback ring 52, the shoulder 100 of the lower gage 36 is capable of introducing a significant stress riser to the primary foldback ring 48, which may degrade the pressure rating of the packer 20. However, the intervening secondary foldback ring 52 serves as a buffer to more evenly distribute the forces on the primary foldback ring 48, which are caused by the shoulder 100. Therefore, when the packer 20 is set, the shoulder 100 does not introduce a sharp edge on the primary foldback ring 48. As a result, the pressure rating of the packer 20 is maximized. Additionally, the secondary foldback ring 48 reduces the extrusion gap of the seal element 32 by effectively increasing the outer diameter of the lower gage 36.

The secondary foldback ring 50 (FIG. 1) performs functions similar to the functions performed by the secondary foldback ring 52.

Figure 4:
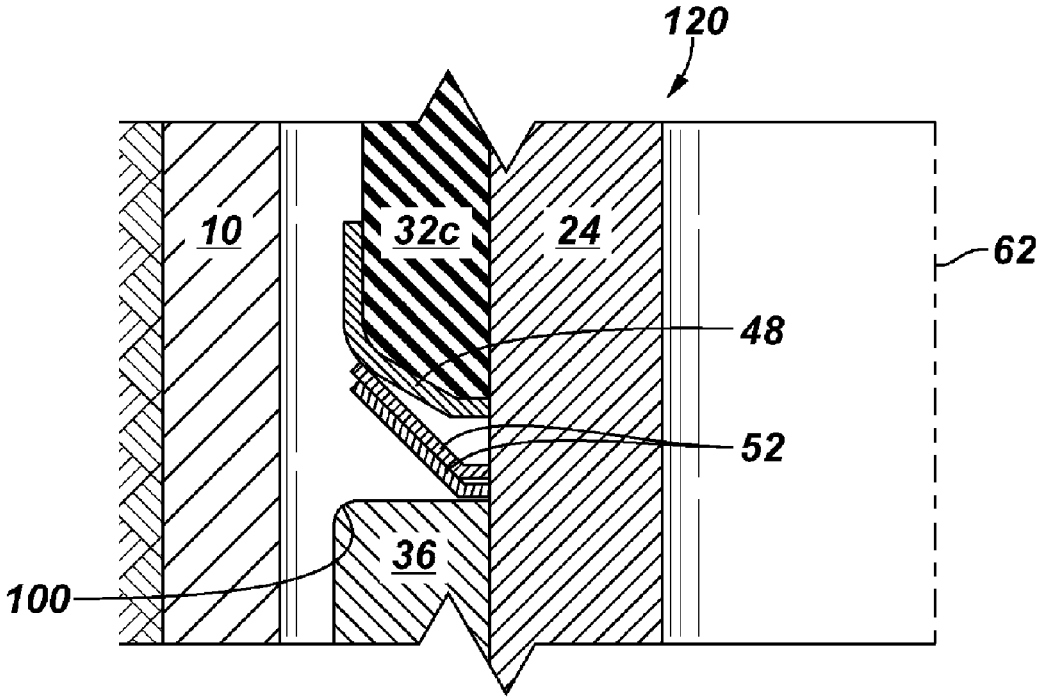
FIG. 4 is a schematic diagram illustrating features of another packer before the packer is set according to another embodiment of the invention.

Other embodiments are within the scope of the appended claims. For example, in accordance with some embodiments of the invention, multiple secondary foldback rings may be used between a gage and the seal element of a packer. FIG. 4 depicts a detailed section 120 of a packer that includes such features according to another embodiment of the invention. The detailed section 120 illustrates a section similar to the section 60 (see FIG. 1) of the packer 20. However, this packer includes multiple secondary foldback rings 52. Due to this arrangement, the seal extrusion gap is further reduced by the thickness of the additional secondary foldback ring 52, as depicted in FIG. 5.

Figure 5:
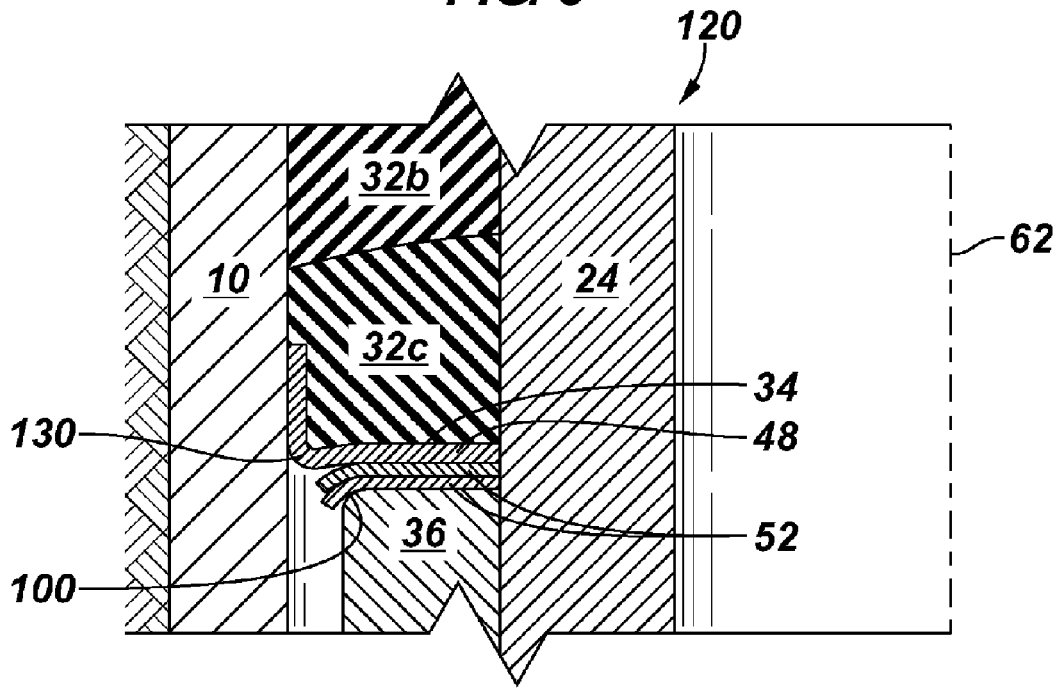
FIG. 5 is a schematic diagram depicting the features of FIG. 4 when the packer is set according to an embodiment of the invention.

Although FIGS. 4 and 5 depict two identical secondary foldback rings 52 between the gage and the sealing element, it is noted that the secondary foldback rings may have different profiles in accordance with other embodiments of the invention.

Figure 6:
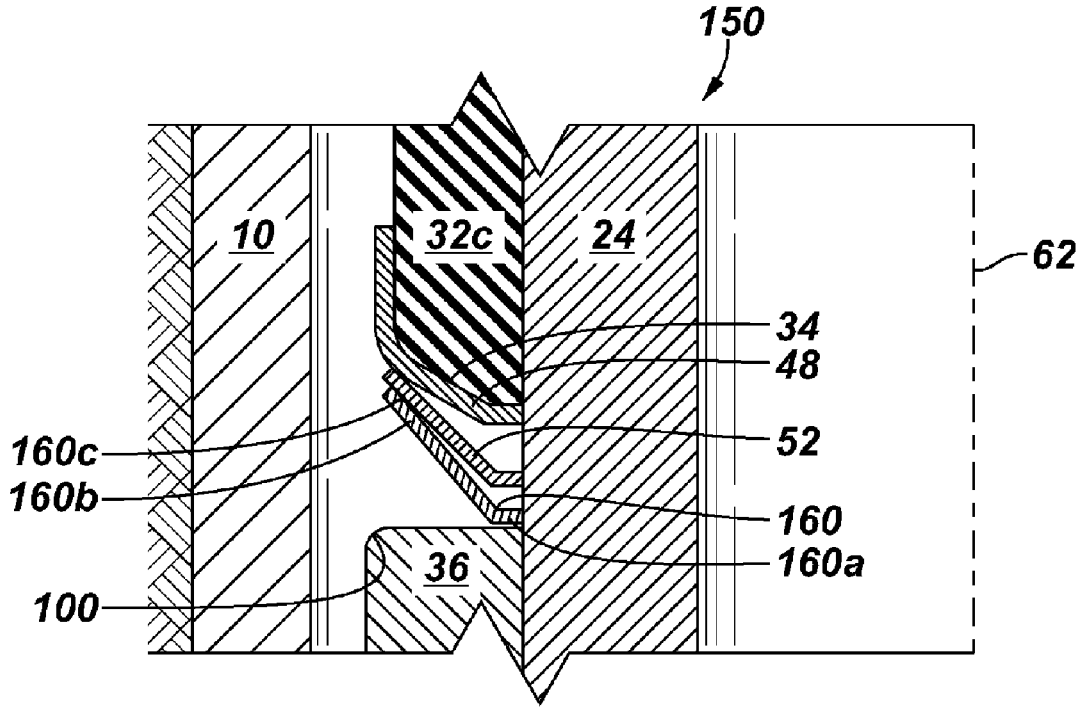
FIG. 6 is a schematic diagram depicting features of another packer before the packer is set according to another embodiment of the invention.

For example, FIG. 6 depicts a detailed section 150 of a packer according to another embodiment of the invention. Unlike the packer 20 or the packer in FIGS. 4 and 5, this packer includes the secondary foldback ring 52; and a secondary foldback ring 160, which has a different profile. As shown in FIG. 6, in accordance with some embodiments of the invention, the secondary foldback ring 160 may be located between the secondary foldback ring 52 and the gage 36.

The secondary foldback ring 160 has the same general two annular section design as the secondary foldback ring 52. In this regard, the secondary foldback ring 160 includes an inner annular section 160*a*, which is generally longitudinally flat and has an inner edge 160*a* that closely circumscribes the outer surface of the tubular member 24. However, an outer annular section 160*b* of the secondary foldback ring 160 is longitudinally inclined at a greater angle than the outer annular section 52*b* (see FIG. 2) of the secondary foldback ring 52. Due to this arrangement, the only portion of the secondary foldback ring 160 that touches the secondary foldback ring 52 (before the packer is set) is an outer edge 160*c* of the secondary foldback ring 160. This maximizes the moment force that is applied to the secondary foldback ring 160 when the packer is set.

Other embodiments are within the scope of the appended claims. For example, in accordance with other embodiments of the invention, the packer may have more than two secondary foldback rings between the seal element of the packer and each gage. As another example, in accordance with some embodiments of the invention, some of the secondary foldback rings may be identical and other of the secondary foldback rings may have different profiles (such as outer annular sections that have different longitudinal inclines, for example). Thus, many variations are possible and are within the scope of the appended claims.

Figure 7:
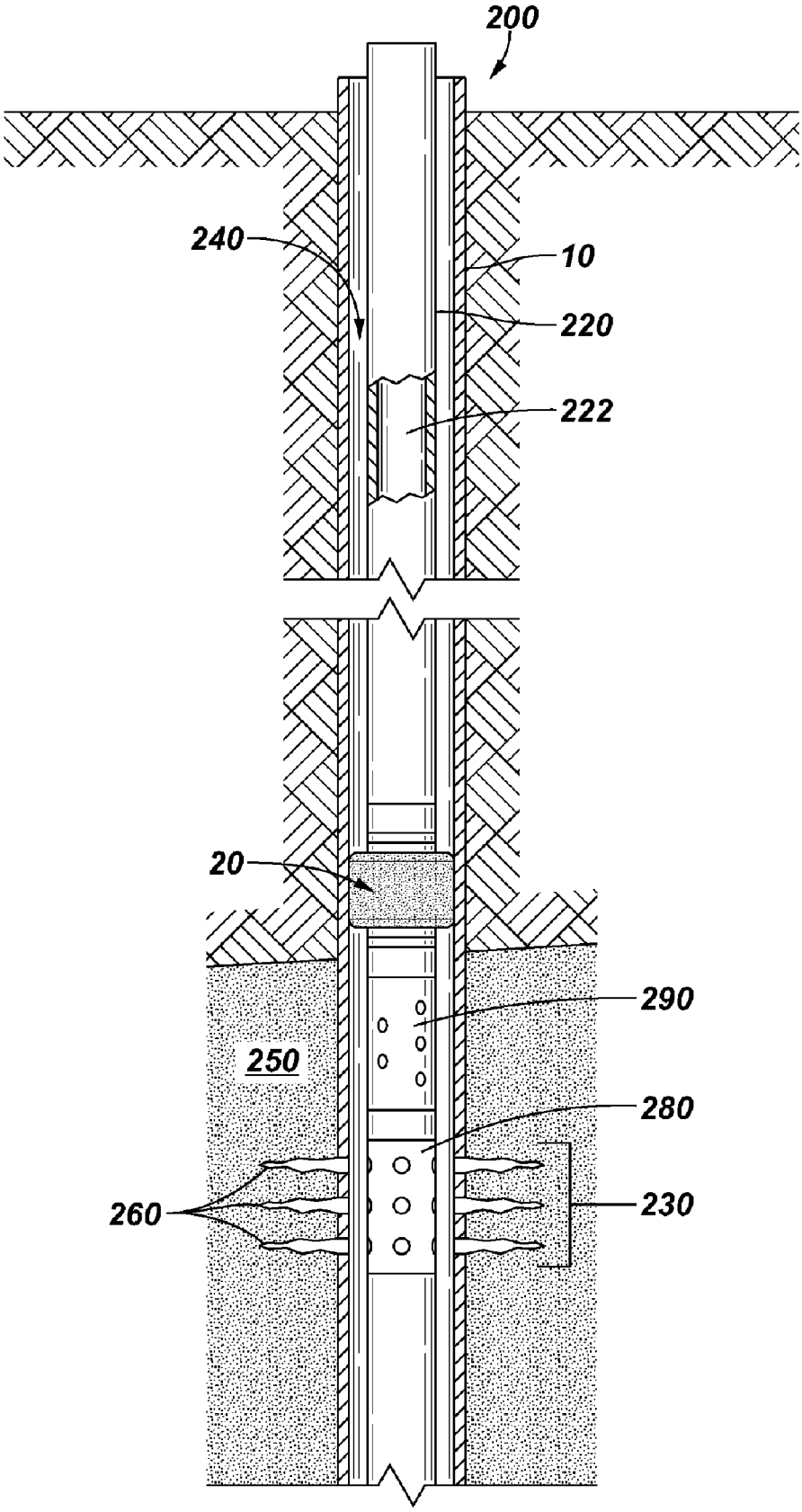
FIG. 7 is a schematic diagram of a well according to an embodiment of the invention.

Referring to FIG. 7, in accordance with some embodiments of the invention, the packer 20 (or any of the other packers that are described herein) may be used in a subterranean well 200. More specifically, the packer 20 may be part of a tubular string, such as a production tubing 220 that extends downhole from the surface of the well. As depicted in FIG. 7, the well may include a wellbore 240 that is lined by the casing 10, although the packer 20 may likewise be used in uncased wellbores in accordance with some embodiments of the invention. Additionally, although FIG. 7 depicts a vertical wellbore, the packer 20 may be used in lateral wellbores. Furthermore, in accordance with some embodiments of the invention, the packer 20 may be used in a subsea well. Thus, many variations are possible and are within the scope of the appended claims.

For the embodiment that is depicted in FIG. 7, the production tubing string 220 may include, for example, a circulation or sleeve valve 290 to receive a flow of fluid from a particular production zone 230. As an example, the production zone 230 may be formed by the firing of a perforating gun 280, which produces corresponding perforation tunnels 260 into a formation 250 of the zone 230. Thus, production fluid from the zone 230 may flow into a central passageway 222 of the production tubing 220 and through the central passageway of the tubular member 24 to the surface of the well.

Although terms of orientation and direction, such as "upper," "lower," etc. have been used in the description herein for purposes of convenience, it is noted that such orientations and directions described herein are not needed to practice the invention. Therefore, in accordance with other embodiments of the invention, the packers that are described herein may be used in other orientations. For example, in accordance with some embodiments of the invention, the gages may move laterally about a lateral tubular member for purposes of compressing a sealing element in between.

The packers that are described herein may be a variety of different packers, such as weight set and hydraulically set packers, as just a few examples.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A packer, comprising:

a sealing element;

a gage;

a first foldback ring located between the sealing element and the gage and comprising an outermost edge, and innermost edge and a single, substantially planar inner surface radially extending from the outermost edge to a position closer to the innermost edge than to the outermost edge; and a second foldback ring located between the first foldback ring and the sealing element and comprising an outer surface to contact an outer portion of the inner surface of the first foldback ring at least prior to the packer being set, the outer surface of the second foldback ring being non-coplanar with respect to the inner surface of the first foldback ring prior to the packer being set.

2. The packer of claim 1, wherein the sealing element comprises at least one elastomer ring.

3. The packer of claim 1, wherein the gage is adapted to compress the sealing element in response to the packer being set.

4. The packer of claim 1, wherein the first and second foldback rings are adapted to control extrusion of the sealing element when the packer is set.

5. The packer of claim 1, wherein the second foldback ring is adapted to conform to an edge of the sealing element before the packer is set.

6. The packer of claim 1, wherein the single, substantially planar inner surface of the first foldback ring forms a first angle with a longitudinal axis of the packer between zero and ninety degrees, the inner surface of the second foldback ring forms a second angle with a longitudinal axis of the packer between zero and ninety degrees, and the first and second angles are different.

7. The packer of claim 6, wherein the first and second angles are oriented to cause only the outer portion of the inner surface of the first foldback ring to contact the second foldback ring before the packer is set.

8. The packer of claim 6, further comprising:

a third foldback ring comprising a third section that forms a third angle with the longitudinal axis of the packer between zero and ninety degrees, and the first angle and third angle are the same.

9. The packer of claim 6, wherein the first angle is larger than the second angle.

10. The packer of claim 1, further comprising:

additional foldback rings located between the gage and the sealing element.

11. The packer of claim 10, wherein the additional foldback rings are substantially identical.

12. A system comprising:

a tubular member to define an annulus in a well; and a packer adapted to seal off the annulus in response to being set, the packer comprising a sealing element, a gage, a first foldback ring, and a second foldback ring, wherein the first foldback ring is located between the sealing element and the gage and comprises an outermost edge, an innermost edge and a single, substantially planar inner surface radially extending from the outermost edge to a position closer to the innermost edge than to the outermost edge, and the second foldback ring is located between the first foldback ring and the sealing element and comprises an outer surface to contact an outer portion of the inner surface of the first foldback ring at least prior to the packer being set, the outer surface of the second foldback ring being non-coplanar with respect to the single, substantially planar inner surface of the first foldback ring prior to the packer being set.

13. The system of claim 12, wherein the tubular member comprises a production tubing string.

14. The system of claim 12, wherein the rings are adapted to control extrusion of the sealing element when the packer is set.

15. A method usable with a well, comprising:

compressing a sealing element between gages to form an annular seal in the well; and controlling extrusion of the sealing element in response to the compression of the sealing element, whereon the act of controlling comprises:

at least partially bending a first foldback ring over a feature of said one of the gages;

causing a second foldback ring to exert a moment force primarily directed at an outermost edge of the first foldback ring to cause the first foldback ring to deform toward said one of the gages; and prior to the act of causing the second foldback ring to exert the moment force, contacting an outer surface of the second foldback ring with an outer portion of a sing, substantially planar inner surface of the first foldback ring, and causing the single, substantially planar inner surface of the first foldback ring which radially extends from the outermost edge of the first foldback ring to a position closer to an innermost edge of the first foldback ring than to the outermost edge of the first foldback ring to be non-coplanar with the outer surface of the second foldback ring.

16. The method of claim 15, wherein the act of controlling comprises:

using the first foldback ring to limit deformation of the second foldback ring.

17. The method of claim 15, where in the act of controlling comprises:

deforming at least one additional foldback ring between said one of the gages and the sealing element.

18. The method of claim 17, wherein said at least one additional foldback ring is substantially identical to the first foldback ring.

* * * * *